US006230507B1

(12) United States Patent
Ban et al.

(10) Patent No.: US 6,230,507 B1
(45) Date of Patent: May 15, 2001

(54) HYBRID COMPRESSOR AND CONTROL METHOD

(75) Inventors: Takashi Ban; Toshiro Fujii; Yoshiyuki Nakane, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/369,970

(22) Filed: Aug. 6, 1999

(30) Foreign Application Priority Data

Aug. 7, 1998 (JP) ..... 10-224952
Aug. 4, 1999 (JP) ..... 11-221678

(51) Int. Cl.[7] ..... F04B 49/06

(52) U.S. Cl. ..... 62/228.4; 62/228.5; 62/236; 62/323.3

(58) Field of Search ..... 62/228.5, 228.4, 62/228.1, 215, 236, 323.3, 196.1, 196.2, 196.3, 230

(56) References Cited

U.S. PATENT DOCUMENTS 2,968,961 1/1961 McGregor .
2,983,111 * 5/1961 Miner et al. ..... 62/228.4 X
4,735,058 * 4/1988 Umezu et al. ..... 62/196.3
4,989,414 * 2/1991 Murayama et al. ..... 62/228.4
5,249,429 10/1993 Hanson ..... 62/86
5,685,160 11/1997 Abersfelder et al. ..... 62/114

FOREIGN PATENT DOCUMENTS 197 38 250A1 3/1999 (DE) .
57-159976 10/1982 (JP) .
5-187356 7/1993 (JP) .
6-087678 12/1994 (JP) .

* cited by examiner

*Primary Examiner*—Harry B. Tanner
(74) *Attorney, Agent, or Firm*—Morgan & Finnegan, LLP

(57) ABSTRACT

A hybrid compressor selectively driven by an engine and an electric motor. The hybrid compressor includes a variable displacement compression mechanism. When the compression mechanism is driven by the motor, the cooling capacity of a refrigeration circuit that includes the hybrid compressor is adjusted by controlling the inclination of the swash plate and the motor speed. In the control procedure, the inclination angle of the swash plate and the motor speed are controlled so that the compression mechanism and the motor are most efficiently operated to achieve the required cooling capacity. Therefore, the hybrid compressor is constantly operated with maximum efficiency.

11 Claims, 6 Drawing Sheets

HYBRID COMPRESSOR AND CONTROL METHOD

BACKGROUND OF THE INVENTION

The present invention relates to a hybrid compressor used mainly for vehicle air-conditioning systems. More specifically, the present invention pertains to a hybrid compressor driven by two drive sources including an engine and an electric motor and its control method.

Generally, a vehicle air-conditioning system includes a refrigeration circuit, which has a compressor and an external circuit connected to the compressor. When the compressor is driven by a vehicle engine, refrigerant circulates in the refrigeration circuit, which cools a vehicle compartment. Typically, the compressor is connected to a single drive source (engine) through an electromagnetic clutch. When the cooling capacity of the refrigeration circuit becomes excessive as the cooling load on the refrigeration circuit decreases, the electromagnetic clutch is turned off, or disengaged, which temporarily stops the operation of the compressor. When the engine is stopped, the compressor is not operated, and the vehicle compartment is not cooled.

Japanese Unexamined Utility Model Publication No. 6-87678 describes a hybrid compressor driven by an engine and an electric motor. The hybrid compressor is driven by the electric motor when the engine is not running, which allows the vehicle passenger compartment to be cooled while the engine is stopped.

The hybrid compressor includes a compression mechanism having a drive shaft, an electric motor having an output shaft connected to the drive shaft, and an electromagnetic clutch connected to the output shaft. The engine is connected to the output shaft through the electromagnetic clutch. When the clutch is engaged while the engine is running, the power of the engine is transmitted to the drive shaft through the output shaft, which operates the compression mechanism. At this time, the output shaft of the electric motor rotates with the drive shaft. The rotation of the output shaft generates electromotive force in the electric motor, and a battery is charged by electric power based on the electromotive force. When the output shaft and the drive shaft are disconnected from the engine by disengaging the clutch while the engine is stopped, the compression mechanism can be driven by the motor, which is powered by the battery.

The compression mechanism of the hybrid compressor is a swash plate type variable displacement compressor. In the compression mechanism, the displacement is controlled by adjusting the inclination angle of the swash plate in accordance with the cooling load on the refrigeration circuit, so that the refrigeration circuit has the appropriate cooling capacity. However, the engine and the electric motor, which are different kinds of drive sources, have different characteristics. Therefore, the operating conditions of the compression mechanism when driven by the engine are different from those when it is driven by the electric motor. This makes it difficult to smoothly shift the drive source of the compression mechanism from the engine to the electric motor.

The motor is powered by a battery, which stores a limited amount of power. Therefore, when the compression mechanism is driven by the electric motor, it is necessary to limit the power consumption by efficiently operating the electric motor in addition to maintaining an appropriate capacity.

Japanese Unexamined Utility Model Publication No. 6-87678 does not attempt to solve this problem.

SUMMARY OF THE INVENTION

An objective of the present invention is to provide a hybrid compressor and its control method that enables smoother shifting of the drive source from the engine to the electric motor.

Another objective of the present invention is to provide a hybrid compressor and its control method that permits efficient operation of the compression mechanism by the electric motor.

To achieve the above objective, the present invention provides a control method for a hybrid compressor having a compression mechanism selectively driven by an engine and an electric motor. The compression mechanism includes a drive shaft selectively driven by the engine and the electric motor. The control method includes controlling the displacement per revolution of the drive shaft and the motor speed when the motor is driving the compression mechanism so that the hybrid compressor is operated efficiently.

The present invention further provides a hybrid compressor selectively driven by an engine and an electric motor. The hybrid compressor includes a compression mechanism having a drive shaft. The drive shaft is selectively driven by the engine and the motor. A controller controls the displacement per revolution of the drive shaft and the motor speed when the compression mechanism is being driven by the motor so that the compressor is operated efficiently.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is a flowchart showing the control procedures of the compressor of FIG. 1.

DETAILED DESCRIPTION OF THE PREFERRED EMBODIMENTS

Figure 1:
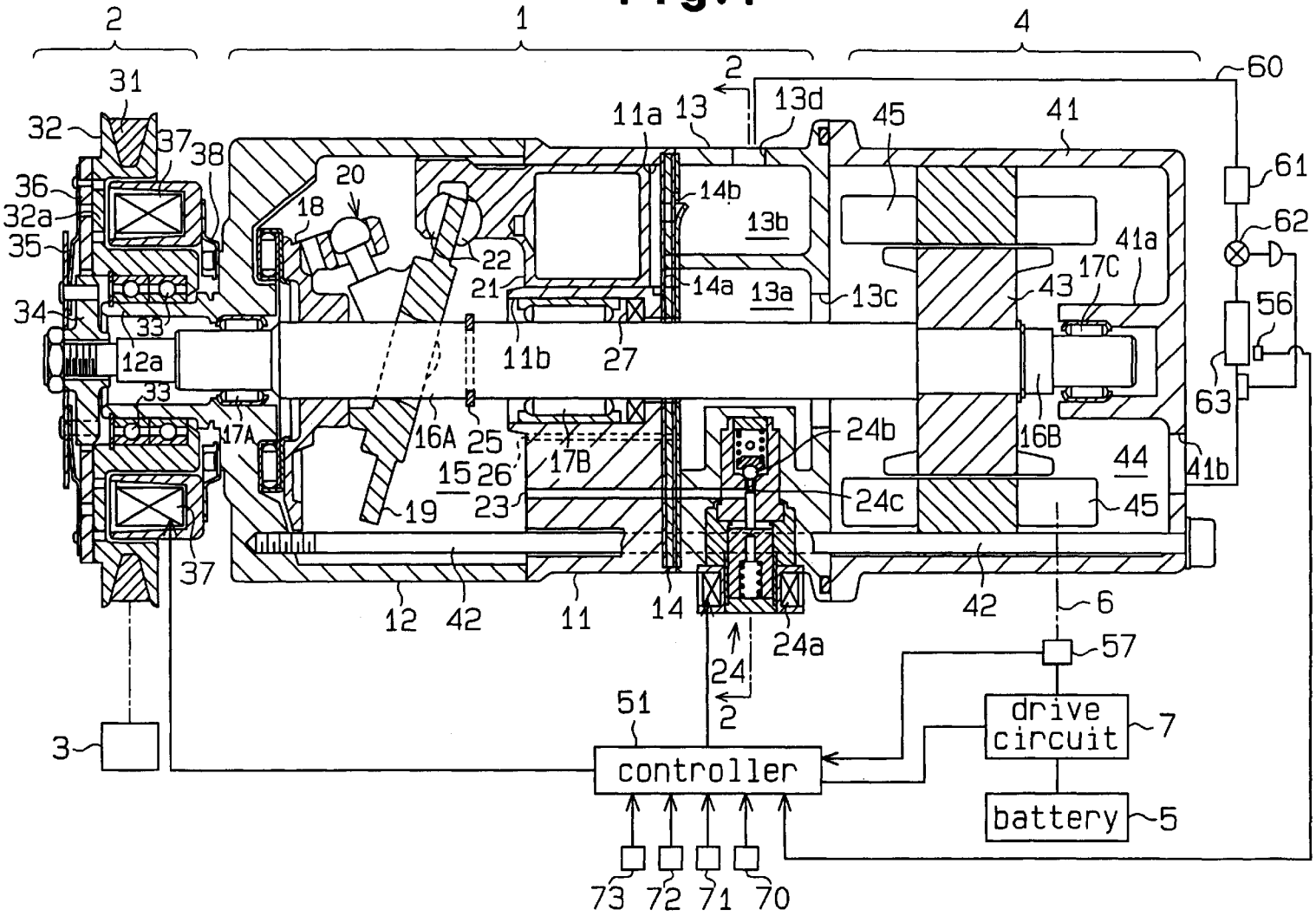
FIG. 1 is a cross sectional view of a hybrid compressor according to one embodiment of the present invention.

A hybrid compressor according to one embodiment of the present invention will now be described with reference to FIGS. 1–5. As shown in FIGS. 1 and 3, the hybrid compressor includes a compression mechanism 1, an electromagnetic clutch 2 and an electric motor 4. The clutch 2 is attached to the front of the compression mechanism 1, and the motor 4 is attached to the rear of the compression mechanism 1. The clutch 2 is attached to a drive shaft 16A and selectively transmits power of a vehicle engine 3 to the drive shaft 16A. The motor 4 is powered by DC power source, or electric power from a battery 5. A drive circuit 7 controls the supply of electric power from the battery 5 to the motor 4 in accordance with instruction from a controller 51. An electric current sensor 57 detects the level of current supplied to the motor 4.

The compression mechanism 1 will now be described with reference to FIGS. 1 and 2. As shown in FIG. 1, the compression mechanism 1 includes a cylinder block 11, a front housing member 12, and a rear housing member 13. The front housing member 12 is joined to the front of the cylinder block 11, and the rear housing member 13 is joined to the rear of the cylinder block 11 through a valve plate 14. A crank chamber 15 is formed between the cylinder block 11 and the front housing member 12. The drive shaft 16A is rotatably supported by the cylinder block 11 and the front housing member 12 through bearings 17A, 17B.

A lug plate 16 is secured to the drive shaft 16A in the crank chamber 15. A awash plate 19 is supported on the drive shaft 16A. The swash plate slides on the surface of the drive shaft in the axial direction, which varies its inclination with respect to the axis of the drive shaft. The swash plate 19 is coupled to the lug plate 18 by a hinge mechanism 20. The hinge mechanism 20 rotates the swash plate 19 together with the lug plate 18 and permits the swash plate to slide axially and incline with respect to the drive shaft 16A.

Figure 2:
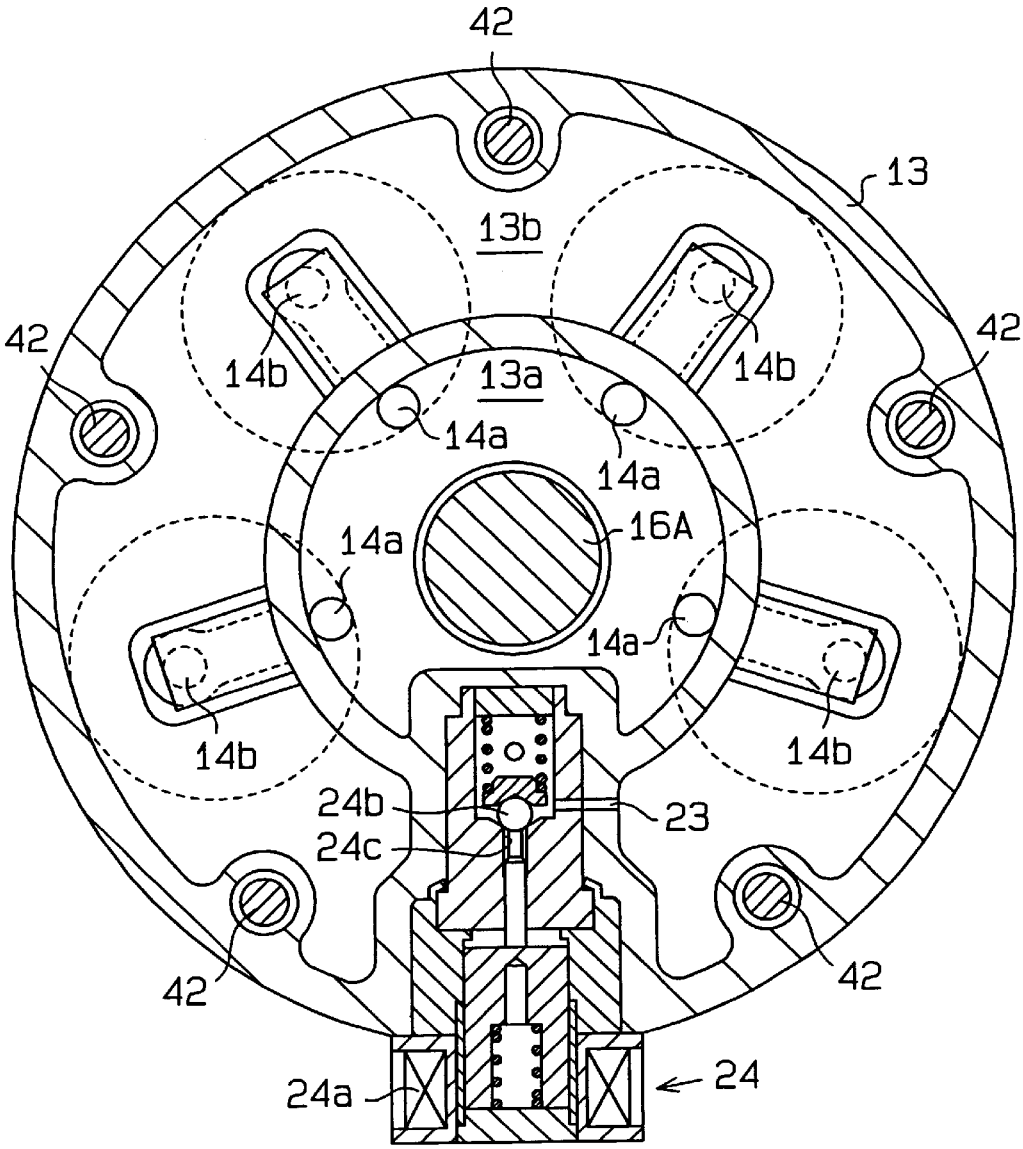
FIG. 2 is a cross sectional view taken on the line 2—2 of FIG. 1.
Figure 3:
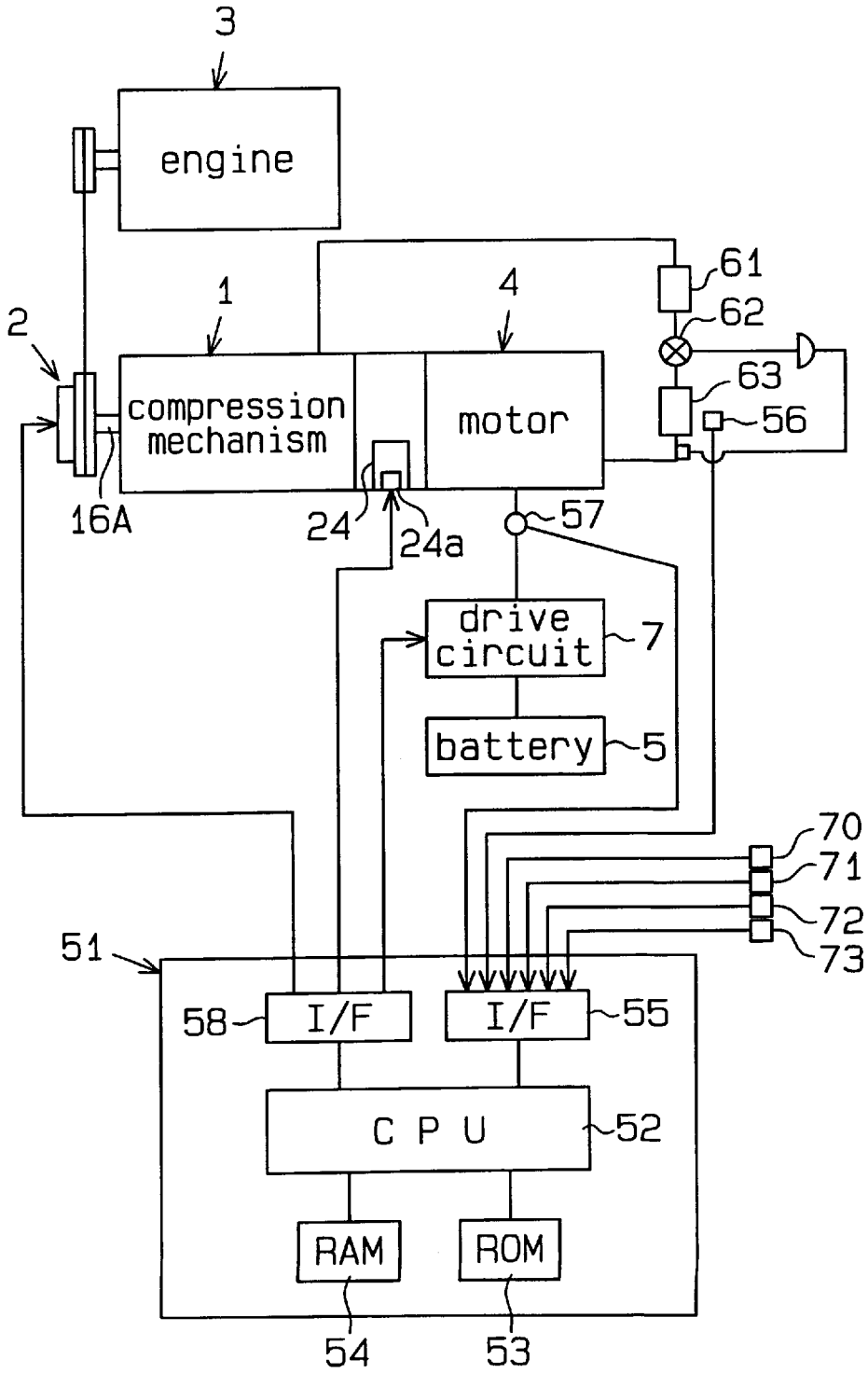
FIG. 3 is a block diagram illustrating the compressor and the controller of FIG. 1.

As shown in FIGS. 1 and 2, cylinder bores 11*a* are formed in the cylinder block 11. A piston 21 is accommodated in each cylinder bore 11*a* and is coupled to the swash plate 19 through a corresponding pair of shoes 22. The swash plate 19 converts the rotation of the drive shaft 16A into reciprocation of each piston 21.

A generally annular suction chamber 13*a* is formed in the rear housing member 13. A generally annular discharge chamber 13*b* is also formed in the rear housing member 13 and surrounds the suction chamber 13*a*. A valve plate 14 includes suction valve mechanisms 14*a* and discharge valve mechanisms 14*b*, which respectively correspond to each cylinder bore 11*a*. Each suction valve mechanism 14*a* admits refrigerant gas from the suction chamber 13*a* to the corresponding cylinder bore 11*a*. Each discharge valve mechanism 14*b* permits compressed refrigerant gas to flow from the corresponding cylinder bore 11*a* to the discharge chamber 13*b*.

A pressurizing passage 23 is formed in the cylinder block 11 and the rear housing member 13 and connects the discharge chamber 13*b* to the crank chamber 15. A displacement control valve 24 is located in the pressurizing passage 23 and is attached to the rear housing member 13. The control valve 24 includes a solenoid 24*a*, a spherical valve body 24*b*, and a valve hole 24*c*. The valve body 24*b* is operated by the solenoid 24*a* to open and close the valve hole 24*c*. When the solenoid 24*a* is de-excited, the valve body 24*b* opens the valve hole 24*c*, that is, opens the pressurizing passage 23. When the solenoid 24*a* is excited, the valve body 24*b* closes the valve hole 24*c*, which closes the pressurizing passage 23.

As shown in FIG. 1, a bleed passage 26 is formed in the cylinder block 11 and connects the crank chamber 15 to the suction chamber 13*a*, the bleed passage 26 bleeds refrigerant gas in the crank chamber 15 to the suction chamber 13*a* so the pressure in the crank chamber 15 does not become too high.

The cylinder block 11 includes an axial hole 11*b*, through which the drive shaft 16A passes. The bearing 17B is located in the axial hole 11*b*. The bearing 17B has a clearance that permits the flow of the gas. Therefore, a seal 27 is provided in the axial hole 11*b* to prevent leakage of refrigerant gas from the crank chamber 15 to the suction chamber 13*a* through the axial hole 11*b*.

When the control valve 24 opens the pressurizing passage 23, high-pressure refrigerant gas is drawn from the discharge chamber 13*b* to the crank chamber 15 through the pressurizing passage 23, thus increasing pressure in the crank chamber 15. As a result, the inclination of the swash plate 19 is reduced, which reduces the stroke of each piston 21 and she displacement of the compression mechanism 1.

A stopper 25 is fixed to the drive shaft 16A. When the swash plate abuts against the stopper 25, the swash plate 19 is positioned at a minimum inclination. The minimum inclination angle of the swash plate 19 is around ten degrees. The inclination angle of the swash plate 19 is measured with respect to a plane perpendicular to the axis of the drive shaft 16A.

When the control valve 24 closes the pressurizing passage 23, the flow of refrigerant gas from the discharge chamber 13*b* to the crank chamber 15 is stopped. Since the refrigerant gas in the crank chamber 15 continues to flow to the suction chamber 13*a* through the bleed passage 26, the pressure in the crank chamber 15 decreases. As a result, the inclination of the swash plate 19 and the stroke of each piston 21 is increased, which increases the displacement of the compression mechanism 1. As shown in FIG. 1, when the swash plate 19 abuts against the lug plate 18, the swash plate 19 is positioned at a maximum inclination.

The control valve 24 adjusts the flow rate of refrigerant gas in the pressurizing passage 23. That is, the position of the valve body 24*b* relative to the valve hole 24*c* is adjusted by varying the amount of electric current supplied to the solenoid 24*a*. This varies the opening size of the valve hole 24*c*, which varies the flow rate of refrigerant gas. Preferably, the supply of electric current to the solenoid 24*a* is controlled by a duty cycle to continually repeat excitation and de-excitation of the solenoid 24*a*. By changing the duty cycle, the ratio of excitation time to de-excitation time, or the ratio of closed time to opened time, is changed. This results in adjusting the flow rate of refrigerant gas in the pressurizing passage 23. In this way, the inclination of the swash plate 19 is arbitrarily adjusted between the minimum inclination and the maximum inclination. Accordingly, the displacement of the compression mechanism 1 is arbitrarily adjusted between the maximum displacement and the minimum displacement. The control valve 24 and the pressurizing passage 23 function as an adjusting mechanism for adjusting the inclination angle of the swash plate 19.

The electromagnetic clutch 2 will now be described. As shown in FIG. 1, the clutch 2 includes a pulley 32. The pulley 32 is rotatably supported by the boss 12*a* at the front end of the front housing member 12 by a radial ball bearing 33. A belt 31 connects the pulley 32 to an engine 3. Power from the engine 3 is transmitted to the pulley 32 through the belt 31. Part of the pulley 32 constitutes a first clutch plate 32*a*. A disc-shaped bracket 34 is fixed to the front end of the drive shaft 16A. A ring-shaped second clutch plate 36 is attached to the bracket 34 by a leaf spring 35. The second clutch plate 36 faces the first clutch plate 32*a*. A solenoid 37 is attached to the front of the front housing member 12 by stays 38 and is located at the opposite side of the pulley 32 from the second clutch plate 36.

When the electromagnetic clutch is turned on, or the solenoid 37 is excited, the second clutch plate 36 is attracted to the solenoid 37 and contacts the first clutch 32*a*, as shown in FIG. 1. Accordingly, the rotation of pulley 32 is transmitted to the drive shaft 16A to drive the compression mechanism 1 through the clutch plates 32*a*, 36, the leaf spring 35, and the bracket 34. When the solenoid 37 is de-excited, the second clutch plate 36 is separated, or disengaged, from the first clutch plate 32*a*, which disconnects the transmission of power from the engine 3 to the drive shaft 16A.

The electric motor 4 will now be described. A motor housing 41 is joined to the rear of the rear housing member 13. As shown in FIGS. 1 and 2, through bolts 42 fasten together the housing members 11, 12, 13 and the motor housing 41. The rear end of the drive shaft 16A passes through the rear housing 13 and is located in the motor housing 41. The part of the drive shaft 16A located in the motor housing 41 functions as an output shaft 16B of the electric motor 4. The rear end of the drive shaft 16A, or the end of the output shaft 16B, is supported by a boss 41*a* through a radial bearing 17C. The boss 41*a* is formed on the inner wall of the motor housing 41. A rotor 43 is fixed to the output shaft 16B. A stator coil 45 is attached to the inner wall of the motor housing 41 to surround the rotor 43.

When electric current is supplied to the stator coil 45 from the battery 5, the output shaft 16B (drive shaft 16A) is rotated with the rotor 43, which operates the compression mechanism 1.

A through hole 13*c* for permitting the passage of the drive shaft 16A is formed in the rear wall of the rear housing member 13. The through hole 13*c* connects the suction chamber 13*a* to an inner space 44 of the motor housing 41. An inlet 41*b* is formed in the rear wall of the motor housing 41 and connects an external circuit 60 to the inner space 44. An outlet 13*d* is formed in a peripheral portion of the rear housing 13 and connects the external circuit 60 to the discharge chamber 13*b*. Refrigerant gas is supplied from the external circuit 60 to the suction chamber 13*a* through the inlet 41*b*, the inner space 44, and the through hole 13*c*. Compressed refrigerant gas is discharged from the discharge chamber 13*b* to the external circuit 60 through the outlet 13*d*.

The external circuit 60 and the compressor constitute a refrigeration circuit for vehicle air conditioning. The external circuit 60 includes a condenser 61, an expansion valve 62, and an evaporator 63. A temperature sensor 56 detects temperature at the outlet of the evaporator 63 and outputs signals indicating the detection result to the controller 51. The temperature at the outlet of the evaporator 63 reflects a cooling load on the refrigeration circuit. Furthermore, the controller 51 is connected to a temperature adjuster 70, a passenger compartment temperature detector 71, an external temperature detector 72, and a rotation speed detector 73. The temperature adjuster 70 sets a target temperature in the passenger compartment. The passenger compartment temperature detector 71 detects the temperature in the passenger compartment. The external temperature detector 73 detects the temperature outside the compartment. The rotation speed detector 73 detects the rotation speed of the output shaft 16B (drive shaft 16A).

As shown in FIG. 3, the controller 51, or a computer, includes a central processing unit (CPU) 52 for various computations, a read only memory (ROM) 53 for storing programs, and a random access memory (RAM) 54 for temporarily memorizing data. The detection signals from the temperature sensor 56, the temperature adjuster 70, the passenger compartment temperature detector 71, the external temperature detector 72, the rotation speed detector 73, and an electric current sensor 57, are input to the CPU 52 through an input interface 55. The CPU 52 calculates the cooling load on the refrigeration circuit based on the detection signals from the temperature sensor 56, the temperature adjuster 70, the passenger compartment temperature detector 71, and the external temperature detector 72. The CPU 52 calculates the torque of the motor 4 based on the level of the electric current supplied to the motor 4, which is detected by the electric current sensor 57. Also, the CPU 52 controls the solenoid 37 of the electromagnetic clutch 2, the solenoid 24*a* of the control valve 24, and the drive circuit 7 by way of the output interface 58.

To calculate the torque of the motor 4, the rotation speed of the output shaft 16B (the drive shaft 16A) may be used in addition to the electric current being supplied to the motor 4. Alternatively, a special torque sensor for detecting the torque of the motor 4 may be provided.

Operation of the above hybrid compressor will now be described with reference to a flowchart of FIGS. 4(*a*) and 4(*b*). The flowchart of FIGS. 4(*a*) and 4(*b*) show one example of a control procedure for the hybrid compressor performed by the controller 51. The routine shown in FIGS. 4(*a*) and 4(*b*) is repeatedly executed while the air-conditioning system is operated.

Figure 4A:
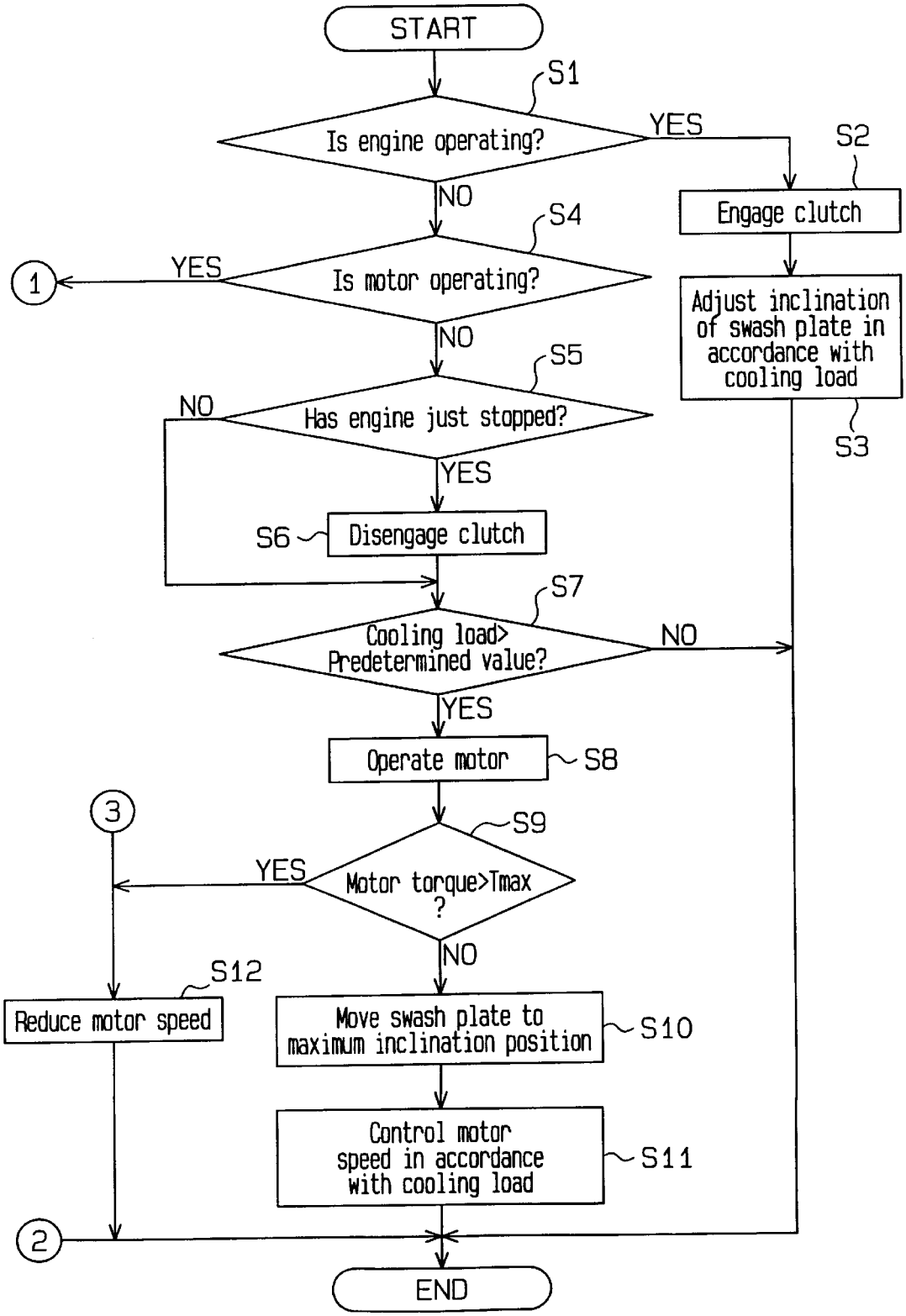
FIG. 4(*a*) is a flowchart showing the control procedures of the compressor of FIG. 1.
Figure 4B:
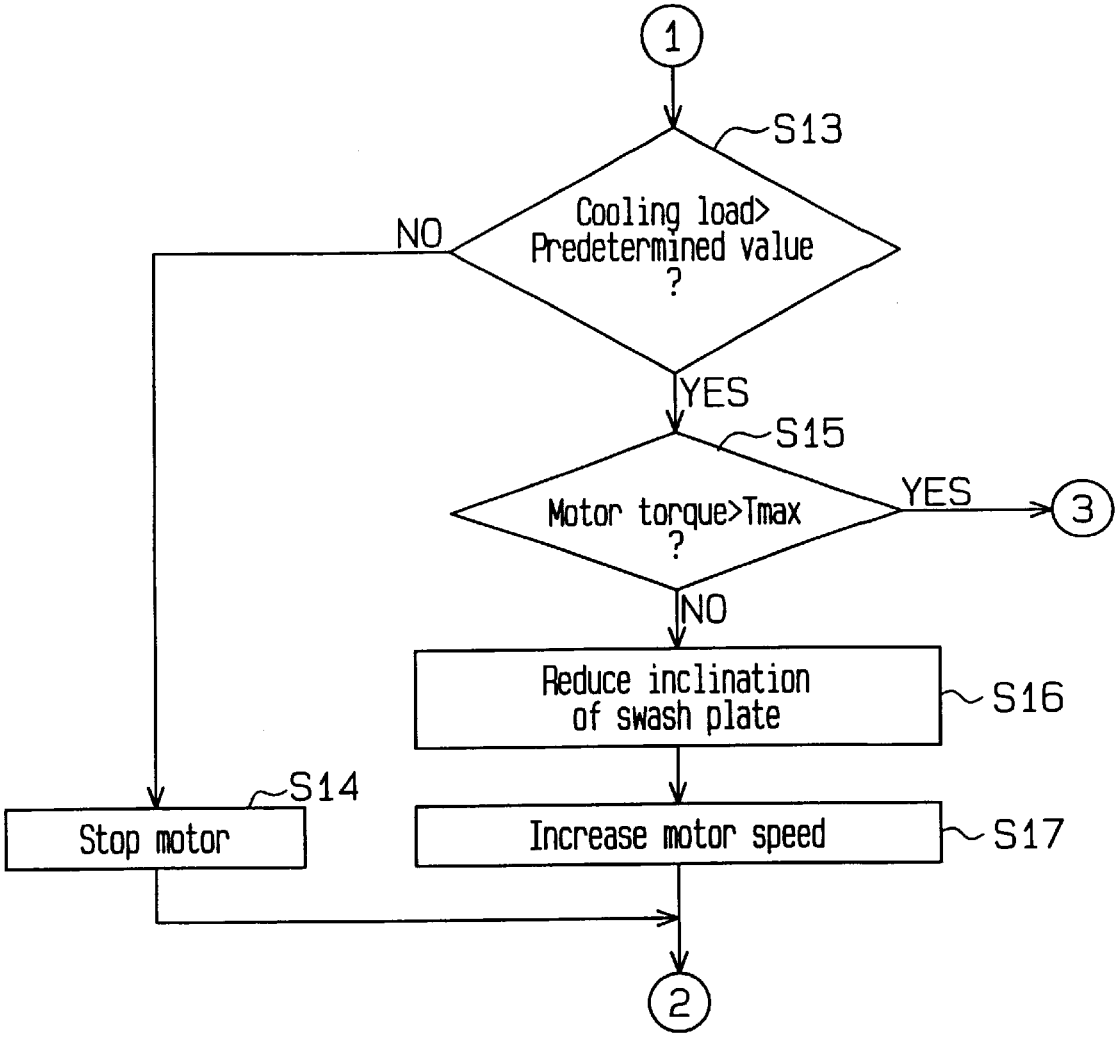

First, in step S1 of FIG. 4(*a*), the controller 51 judges whether the engine 3 is operating. If the engine 3 is operating, the controller 51 moves to step S2 and turns on the electromagnetic clutch 2. At this time, the controller 51 instructs the drive circuit 7 to prevent current from flowing from the battery 5 to the electric motor 4. Accordingly, the compression mechanism 1 is driven by the engine 3.

At step S3, the controller 51 controls the control valve 24, adjusts the inclination angle of the swash plate 19, and terminates the procedure. As already mentioned, the controller 51 recognizes the cooling load based on detection signals from the temperature sensor 56, the temperature adjuster 70, the compartment temperature detector 71, and the external temperature detector 72. For example, when the cooling load is great, ache controller 51 controls the control valve 24 to reduce the opening size of the pressurizing passage 23 so that the cooling capacity of the refrigeration circuit is increased. This reduces the supply of refrigerant gas to the crank chamber 15 from the discharge chamber 13*b* through the pressurizing passage 23, which reduces the pressure in the crank chamber 15. As a result, the inclination angle of the awash plate 19 is increased, which increases the displacement of the compression mechanism 1.

In contrast, when the cooling load is small, the controller 51 controls the control valve 24 to increase the opening size of the pressurizing passage 23 so that the cooling capacity of the refrigeration circuit is reduced. This increases the supply of refrigerant gas to the crank chamber 15 from the discharge chamber 13*b* through the pressurizing passage 23, which increases the pressure in the crank chamber 15. As a result, the inclination angle of the swash plate 19 is reduced, which reduces the displacement of the compression mechanism 1.

In this way, when the compression mechanism 1 is driven by the engine 3, the swash plate 19 is moved between the maximum inclination position and the minimum inclination position in accordance with the cooling load on the refrigeration circuit, and the displacement of the compression mechanism 1 is adjusted to an arbitrary displacement between the maximum displacement and the minimum displacement.

The displacement of the compression mechanism 1, or the cooling capacity of the refrigeration circuit, is determined by the rotation speed of the drive shaft 16A and the displacement per revolution of the drive shaft 16A. However, when the compression mechanism 1 is driven by the engine 3, the rotation speed of the engine 3, or the rotation speed of the drive shaft 16A cannot be varied for the purposes of the refrigeration circuit. Therefore, the cooling capacity of the refrigeration circuit is adjusted by controlling the inclination angle of the swash plate 19. For example, if the rotation speed of the engine 3 increases when maintaining the currently required cooling capacity is required, the inclination angle of the swash plate 19 decreases, which reduces the displacement per revolution of the drive shaft 16A. As a result, the displacement per unit time is unchanged, which maintains the current cooling capacity regardless of the fluctuation of the rotation speed of the engine 3.

When the drive shaft 16A of the compression mechanism 1 is driven by the engine 3, the output shaft 16B of the motor 4 rotates with the rotor 43. The rotation of the rotor 43 generates electromotive force in the stator coil 45, and the battery 5 is charged with the electric power based on the electromotive force.

On the other hand, when the engine 3 is not operating in step S1, the controller 51 proceeds to step S4 and judges whether the motor 4 is operating. When the motor 4 is not operating, the controller 51 proceeds to step S5 and judges whether the engine 3 has just stopped. When the engine 3 has just stopped, the controller proceeds to step S6, disengages the clutch 2, and proceeds to step S7. Therefore, the drive shaft 16A is disconnected from the engine 3. When there is no determination that the engine 3 has just stopped, or when the compression mechanism 1 is not operating, the controller 51 proceeds to step S1 without executing step S6.

At step S7, the controller 51 judges whether the cooling load of the refrigeration circuit is greater than a predetermined value. When the cooling load is not greater than the predetermined value, the controller 51 judges that the refrigeration circuit has extra cooling capacity and terminates the procedure. Accordingly, the compression mechanism 1 is not driven.

On the other hand, when the cooling load is greater than the predetermined value, the controller 51 judges that the refrigeration circuit requires cooling capacity and proceeds to step S8. At step S8, the controller 51 controls the drive circuit 7 to supply electric current from the battery 5 to the motor 4. Accordingly, the output shaft 16B of the motor 4 is rotated, and the compression mechanism 1 is driven by the motor 4.

At step S9, the controller 51 judges whether the torque of the motor 4 is greater than a predetermined upper limit value Tmax, based on the detection signal from the electric current sensor 57. The upper limit value Tmax represents the upper limit of a normal torque range of the motor 4. The data concerning the upper limit value Tmax is stored in the ROM 53 as some of the data representing the operation characteristics of the motor 4.

When the torque of the motor 4 is equal to or less than the upper limit value Tmax, the controller 51 judges that the motor 4 is operating normally, proceeds to step S10 and controls the control valve 24 to position the swash plate 19 at the maximum inclination angle. When the swash plate 19 is already fully inclined, its angle is not changed. Subsequently, at step S11, the controller 51 controls the rotation speed of the motor 4 and terminates the procedure, so that the displacement of the compression mechanism 1 corresponds to the present cooling load. That is, the compression mechanism 1 is operated so that the refrigeration circuit has a cooling capacity that corresponds to the present cooling load.

When the torque of the motor 4 is greater than the upper limit value Tmax, the controller 51 judges that the motor 4 cannot be operated normally and proceeds to step S12. At step S12, the controller 51 reduces the rotation speed of the motor 4 so that the torque of the motor 4 approaches the upper limit value Tmax and terminates the procedure.

On the other hand, when the controller judges that the motor 4 is operating at step S4, the controller 51 proceeds to step S13 of FIG. 4(*b*) and judges whether the cooling load of the refrigeration circuit is greater than the predetermined value. When the cooling load is not greater than the predetermined value, the controller 51 judges that the refrigeration circuit has extra cooling capacity, proceeds to step 14, stops the motor 4, and terminates the procedure. Accordingly, the operation of the compression mechanism 1 is stopped.

When the cooling load is greater than the predetermined value, the controller 51 judges that the refrigeration circuit requires cooling capacity and moves to step S15. At step S15, the controller judges whether the torque of the motor 4 is greater than the upper limit value Tmax. When the torque is equal to or less than the upper limit value Tmax, the controller 51 judges that the motor 4 can operate normally, moves to step S16 and controls the control valve 24 to reduce the inclination angle of the swash plate 19. Subsequently, at step S17, the controller 51 increases the rotation speed of the motor 4 and terminates the procedure, so that the compression mechanism 1 is operated with a displacement in accordance with the present cooling load. The degree of reduction of the inclination angle of the swash plate 19 and the degree of increase of the rotation speed of the motor 4 is determined in accordance with the cooling load and the torque of the motor 4.

When the torque of the motor 4 is greater than the upper limit value Tmax in step S15, the controller 51 judges that the motor 4 cannot be operated normally, proceeds to step S12 of FIG. 4(*a*) and reduces the rotation speed of the motor 4.

When the engine 3 is operated again, the procedures of steps S2 and S3 are executed. That is, the controller 51 engages the clutch 2 and instructs the drive circuit 7 to stop the supply of electric current to the motor 4. Accordingly, the compression mechanism 1 is operated again by the engine 3, and the battery 5 is charged again with the power based on the electromotive force generated in the motor 4.

As described, right after the drive source of the compression mechanism 1 is shifted from the engine 3 to the motor 4 or right after the operation of the compression mechanism 1 is resumed by the motor 4, the swash plate 19 is moved to the maximum inclination angle position assuming the motor torque is in the normal range. In other words, when the operation of the compression mechanism 1 by the motor 4 is started, the displacement per revolution of the drive shaft 16A is increased. The rotation speed of the motor 4 is adjusted such that the displacement of the compression mechanism. 1 corresponds to the present cooling load (steps S10, S11).

To maintain the displacement of the compressor mechanism 1 at a certain level without changing the inclination angle of the swash plate 19 when the drive source of the compression mechanism 1 is shifted from the engine 3 to the motor 4, the rotation speed of the drive shaft 16A must be maintained at a certain level. However, the rotation speed of the motor 4 is unsteady right after the drive source of the compression mechanism 1 is shifted from the engine 3 to the motor 4, and it is difficult to increase the rotation speed of the motor 4 suddenly. Accordingly, when the drive shaft 16A is driven by the engine 3 at a relatively high speed and the engine 3 is then stopped, it is difficult to operate the motor 4 such that the rotation speed of the drive shaft 16A does not fall, which would temporarily reduce the displacement of the compression mechanism 1. Also, the rotation speed of the motor 4 is unsteady when the compression mechanism 1 is initially started by the motor 4, and it is difficult to suddenly increase the rotation speed of the motor 4.

However, in the illustrated embodiment, when the operation of the compression mechanism 1 by the motor 4 is started, the displacement per revolution of the drive shaft 16A is maximized by moving the swash plate 19 to its maximum inclination angle position. Therefore, when operation of the compression mechanism 1 by the motor 4 is started, the displacement of the compression mechanism 1, or the cooling capacity of the refrigeration circuit, is relatively high regardless of the relatively low rotation speed of the motor 4. Accordingly, when operation of the compression mechanism 1 by the motor 4 is started, the rotation speed of the motor 4 need not be suddenly increased. This stabilizes the operation of the compression mechanism 1 and makes shifting the drive source from the engine 3 to the motor 4 more smooth. Furthermore, the load applied to the motor 4 is lowered, which makes the operation of the hybrid compressor as a whole more efficient.

If the displacement of the compression mechanism needs to be increased further when the motor 4 is being operated, the inclination angle of the swash plate 19 is reduced and the rotation speed of the motor 4 is increased. In other words, the displacement per revolution of the drive shaft 16A is decreased and the rotation speed of the motor 4 is increased (steps S16, S17). When the motor is being operated, the consumption of power by the motor 4 is reduced and the efficiency of the hybrid compressor is improved if the cooling capacity of the refrigeration circuit is increased by increasing the rotation speed of the motor 4 instead of the inclination angle of the swash plate 19. This has been confirmed by the inventors.

When the cooling load on the refrigeration circuit is less than or equal to the predetermined value, or when the refrigeration circuit has an extra cooling capacity, the operation of the compression mechanism by the motor 4 is stopped. Therefore, operation of the compression mechanism 1 by the motor 4 is stopped when cooling is not required, which minimizes the consumption of power by the motor 4. This prevents unnecessary battery drain and raises the efficiency of the hybrid compressor.

When the torque of the motor 4 is greater than the upper limit value Tmax, the rotation speed of the motor 4 is reduced. This prevents excessive load on the motor 4.

As described, when the compression mechanism 1 is driven by the motor 4, the cooling capacity of the refrigeration circuit is adjusted by controlling the inclination angle of the swash plate 19 and the rotation speed of the motor 4. During this time, the controller 51 controls the control valve 24 and the drive circuit 7 to control the inclination angle of the swash plate 19 and the rotation speed of the motor 4, so that the compression mechanism 1 and the motor are most efficiently operated to achieve the required cooling capacity. In other words, the hybrid compressor is operated all the time at high efficiency to reduce the power consumption of the motor 4.

Figure 5:
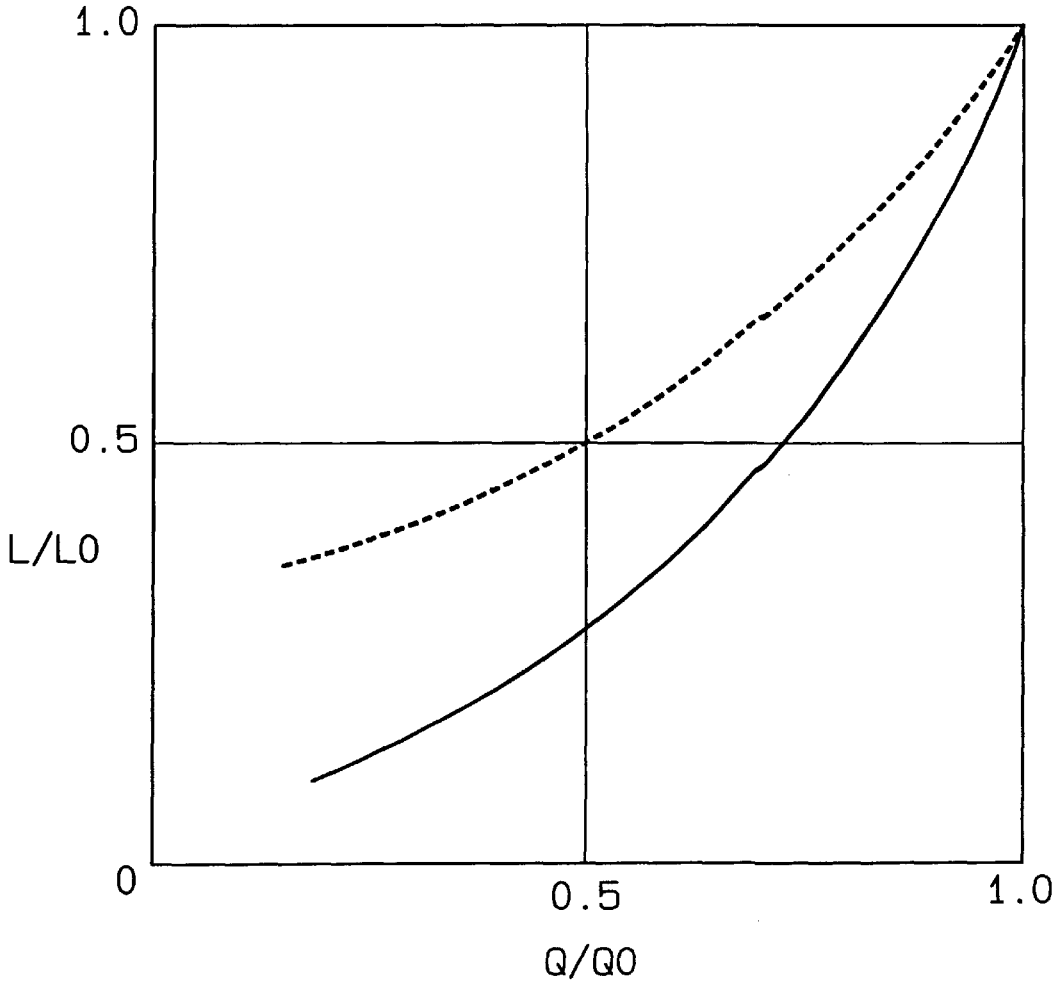
FIG. 5 is a graph showing the capacity-power characteristics of the compressor of FIG. 1.

The compression mechanism 1 of the present embodiment is a piston-type variable displacement compressor. Compared to a scroll-type variable displacement compressor, the power used by the motor 4 is reduced with this type of the compression mechanism 1. FIG. 5 shows the capacity-power characteristics of the compression mechanism 1 and a scroll-type variable displacement compressor, respectively. In the graph of FIG. 5, the horizontal axis represents the ratio of the actual displacement Q to the maximum displacement Q0 (displacement ratio Q/Q0), and the vertical axis represents the ratio of the actual power L to the maximum power L0 (power ratio L/L0). The solid line shows the characteristics of the compression mechanism 1 of FIG. 1, and the dotted line shows the characteristics of the scroll-type variable displacement compressor. As indicated by the graph of FIG. 5, for example, when the capacity ratio Q/Q0 is 0.5, the power ratio L/L0 of the compression mechanism 1 is 0.3, and the power ratio L/L0 of a scroll-type variable displacement compressor is 0.5. The power ratio, or power loss, of the compression mechanism 1 is smaller than that of a scroll-type variable displacement compressor when the capacity ratio is the same. Accordingly, the illustrated embodiment is more efficient since it uses the piston-type variable displacement compressor 1.

The present invention can further be varied as follows.

The control procedure shown in FIGS. 4(*a*) and 4(*b*) is merely exemplary and may be changed. For example, at step S10, the swash plate 19 may be moved to the vicinity of the maximum inclination position without reaching the maximum inclination position. Also, in step S12, the inclination angle of the swash plate 19 may be reduced instead of or in addition to reducing the rotation speed of the motor 4. Furthermore, in steps S16, S17, the rotation speed of the motor 4 may be increased without reducing the inclination angle of the swash plate 19. That is, the present invention is not limited to the control steps shown in FIGS. 4(*a*) and 4(*b*) but may be embodied in any control procedures provided that the inclination angle of the swash plate 19 and the rotation speed of the motor 4 are controlled to achieve the most efficient operation the hybrid compressor.

The bearing 17B supporting the middle portion of the drive shaft 16A may be omitted and only the ends of the drive shaft 16A may be supported by the bearings 17A, 17C. This simplifies the structure of the compressor.

In the embodiment of FIG. 1, the output shaft 16B of the motor 4 is a part of the drive shaft 16A of the compression mechanism 1. However, an output shaft 16B that is independent from the drive shaft may be coupled to the drive shaft 16A by a coupler.

In the embodiment of FIG. 1, the refrigerant gas is admitted to the suction chamber 13*a* from the external circuit 60 through the inner space 44 of the motor 4. Instead, an inlet of refrigerant gas from the external circuit 60 to the suction chamber 13*a* may be formed in the rear housing member 13 of the compression mechanism 1, and the passage of refrigerant gas through the inner space 44 of the motor 4 may be prevented.

The compressor of FIG. 1 is a variable displacement compressor using a swash plate 19 that varies piston stroke in accordance with the inclination of the awash plate 19. However, the present invention may he embodied in other types of compressors, such as, a vane type variable displacement compressor or a scroll-type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A control method for a hybrid compressor having a compression mechanism selectively driven by an engine and an electric motor, wherein the compression mechanism includes a drive shaft selectively driven by the engine and the electric motor, the control method comprising:

controlling the displacement per revolution of the drive shaft and the motor speed when the motor is driving the compression mechanism so that the hybrid compressor is operated efficiently, wherein the displacement per revolution of the drive shaft is varied when the motor starts the compression mechanism.

2. The control method according to claim 1, wherein the displacement per revolution of the drive shaft is increased when the motor starts the compression mechanism.

3. The control method according to claim 1, wherein the motor is stopped when the cooling load on a refrigeration circuit that includes the hybrid compressor is equal to or smaller than a predetermined value while the compression mechanism is driven by the motor.

4. A control method for a hybrid compressor having a compression mechanism selectively driven by an engine and an electric motor, wherein the compression mechanism includes a drive shaft selectively driven by the engine and the electric motor, the control method comprising:

controlling the displacement per revolution of the drive shaft and the motor speed when the motor is driving the compression mechanism so that the hybrid compressor is operated efficiently wherein the displacement per revolution of the drive shaft is varied when the drive source of the compression mechanism is changed from the engine to the motor.

5. A control method for a hybrid compressor having a compression mechanism selectively driven by an engine and an electric motor, wherein the compression mechanism includes a drive shaft selectively driven by the engine and the electric motor, the control method comprising:

increasing the motor speed when it is necessary to increase the cooling capacity of a refrigeration circuit that includes the hybrid compressor when the compression mechanism is being deiven by the motor; and varying the displacement per revolution of the drive shaft when the motor speed is increased so that the hybrid compressor is operated efficiently.

6. A control method for a hybrid compressor having a compression mechanism selectively driven by an engine and an electric motor, wherein the compression mechanism includes a drive shaft selectively driven by the engine and the electric motor, the control method comprising:

controlling the displacement per revolution of the drive shaft and the motor speed when the motor is driving the compression mechanism so that the hybrid compressor is operated efficiently, wherein the motor speed is reduced when the torque of the motor driving the compression mechanism is greater than a predetermined upper limit.

7. A hybrid compressor selectively driven by an engine and an electric motor, the hybrid compressor comprising:

a compression mechanism, wherein the compression mechanism includes:

a drive shaft, wherein the drive shaft is selectively driven by the engine and the motor;

a swash plate, which is inclinably supported by the drive shaft;

a piston, which is coupled to the swash plate, wherein the piston reciprocates with the movement of the swash plate; and an adjusting mechanism for adjusting the inclination angle of the swash plate, wherein the swash plate varies the piston stroke in accordance with the inclination angle to vary the displacement per revolution of the drive shaft; and a controller for controlling the displacement per revolution of the drive shaft and the motor speed when the compression mechanism is being driven by the motor so that the compressor is operated efficiently, wherein the controller controls the adjusting mechanism to increase the inclination angle of the swash plate when the motor starts driving the compression mechanism.

8. The hybrid compressor according to claim 7, wherein the controller stops the motor when the cooling load on a refrigeration circuit that includes the hybrid compressor is equal to or less than a predetermined value while the compression mechanism is driven by the motor.

9. A hybrid compressor selectively driven by an engine and an electric motor, the hybrid compressor comprising:

a compression mechanism, wherein the compression mechanism includes: a drive shaft, wherein the drive shaft is selectively driven by the engine and the motor;

a swash plate, which is inclinably supported by the drive shaft;

a piston, which is coupled to the swash plate, wherein the piston reciprocates with the movement of the swash plate; and an adjusting mechanism for adjusting the inclination angle of the swash plate, wherein the swash plate varies the piston stroke in accordance with the inclination angle to vary the displacement per revolution of the drive shaft; and a controller for controlling the displacement per revolution of the drive shaft and the motor speed when the compression mechanism is being driven by the motor so that the compressor is operated efficiently, wherein the controller controls the adjusting mechanism to increase the inclination angle of the swash plate when the drive source of the compression mechanism is changed from the engine to the motor.

10. A hybrid compressor selectively driven by an engine and an electric motor, the hybrid compressor comprising:

a compression mechanism, wherein the compression mechanism includes:

a drive shaft, wherein the drive shaft is selectively driven by the engine and the motor;

a swash plate, which is inclinably supported by the drive shaft;

a piston, which is coupled to the swash plate, wherein the piston reciprocates with the movement of the swash plate; and an adjusting mechanism for adjusting the inclination angle of the swash plate, wherein the swash plate varies the piston stroke in accordance with the inclination angle to vary the displacement per revolution of the drive shaft; and a controller for controlling the displacement per revolution of the drive shaft and the motor speed when the compression mechanism is being driven by the motor so that the compressor is operated efficiently, wherein the controller increases the motor speed when it is necessary to increase the cooling capacity of a refrigeration circuit that includes the hybrid compressor when the compression mechanism is being driven by the motor, wherein the controller controls the adjusting mechanism to reduce the inclination angle of the swash plate when the motor speed is increased.

11. A hybrid compressor selectively driven by an engine and an electric motor, the hybrid compressor comprising:

a coression mechanism having a drive shaft, wherein the drive shaft is selectively driven by the engine and the motor; and a controller for controlling the displacement per revolution of the drive shaft and the motor speed when the compression mechanism is being driven by the motor so that the compressor is operated efficiently, wherein the controller reduces the motor speed when the driving torque of the motor is greater than a predetermined upper limit.

* * * * *

UNITED STATES PATENT AND TRADEMARK OFFICE

CERTIFICATE OF CORRECTION

PATENT NO. : 6,230,507 B1
DATED : May 15, 2001
INVENTOR(S) : Takashi Ban et al.

It is certified that error appears in the above-identified patent and that said Letters Patent is hereby corrected as shown below:

Column 3,
Line 9, please change "A lug plate 16 is" to -- A lug plate 18 is --;
Line 51, please change "suction chamber 13a, the bleed" to -- suction chamber 13a. The bleed --;

Column 6,
Line 27, please change "great, ache controller 51" to -- great, the controller 51 --;

Column 10,
Line 46, please change "of the awash plate" to -- of the swash plate --;

Column 11,
Line 28, please change "mechanism is being deiven" to -- mechanism is being driven --;

Signed and Sealed this

Twenty-first Day of May, 2002

*Attest:*

*Attesting Officer*

JAMES E. ROGAN
*Director of the United States Patent and Trademark Office*